US012774868B2

(12) United States Patent
Boruchowski et al.

(10) Patent No.: US 12,774,868 B2
(45) Date of Patent: Oct. 27, 2026

(54) SHOTGUN OPTIC PLATE WITH INTEGRATED REAR SIGHT

(71) Applicant: Palmetto State Armory, LLC, Columbia, SC (US)

(72) Inventors: Thaddeus Boruchowski, Columbia, SC (US); Ryan Crisp, Columbia, SC (US); Chris Daniels, Columbia, SC (US); Ralph Stephen Fisher, Columbia, SC (US); Mark Mnich, Columbia, SC (US); Thomas Victa, Columbia, SC (US)

(73) Assignee: Palmetto State Armory, LLC, Columbia, SC (US)

( * ) Notice: Subject to any disclaimer, the term of this patent is extended or adjusted under 35 U.S.C. 154(b) by 0 days.

(21) Appl. No.: 19/029,938

(22) Filed: Jan. 17, 2025

(65) Prior Publication Data

US 2025/0237477 A1 Jul. 24, 2025

Related U.S. Application Data

(60) Provisional application No. 63/622,746, filed on Jan. 19, 2024.

(51) Int. Cl.

| | |
|---|---|
| ***F41G 1/10*** | (2006.01) |
| ***F41G 1/46*** | (2006.01) |
| ***F41G 11/00*** | (2006.01) |

(52) U.S. Cl.

CPC ..... *F41G 1/10* (2013.01); *F41G 1/46* (2013.01); *F41G 11/001* (2013.01)

(58) Field of Classification Search

CPC ..... F41G 11/001; F41G 1/46; F41G 1/10
USPC ..... 42/111
See application file for complete search history.

(56) References Cited

U.S. PATENT DOCUMENTS

| | | | | |
|---|---|---|---|---|
| 9,506,726 | B2 * | 11/2016 | Wolf | F41G 1/26 |
| 10,871,350 | B1 * | 12/2020 | Thomas | F41G 1/16 |
| 11,460,274 | B2 * | 10/2022 | Dawson, Jr. | F41G 11/001 |
| 11,859,945 | B1 * | 1/2024 | Kim | F41G 1/02 |
| 12,130,120 | B2 * | 10/2024 | Langdon | F41G 1/16 |
| D1,091,745 | S * | 9/2025 | Johnson | D22/108 |
| 12,405,089 | B2 * | 9/2025 | Underwood | F41G 11/001 |
| 2019/0257620 | A1 * | 8/2019 | Zimmer | F41C 3/00 |
| 2022/0390206 | A1 * | 12/2022 | Hamilton | F41G 1/345 |

OTHER PUBLICATIONS https://gunsweek.com/en/shotguns/news/mossberg-940-pro-tactical-optics-ready-shotgun (Mar. 26, 2022).*

* cited by examiner

*Primary Examiner* — John Cooper
(74) *Attorney, Agent, or Firm* — Douglas L. Lineberry; Maynard Nexsen PC

(57) ABSTRACT

Described herein are a shotgun optic plate cover, and methods for making and installing same as well as retrofitting existing shotguns to accommodate the shotgun optic plate cover, with an integrated rear sight to enable either optics enhanced, or non-optics enhanced aiming capabilities for shotguns.

20 Claims, 4 Drawing Sheets

SHOTGUN OPTIC PLATE WITH INTEGRATED REAR SIGHT

This application claims the benefit of U.S. Provisional Patent Application No. 63/622,746, filed Jan. 19, 2024, the disclosure of this application is expressly incorporated herein by reference in its entirety.

TECHNICAL FIELD

The subject matter disclosed herein is generally directed to a shotgun optic plate cover with an integrated rear sight, and methods for making and installing same as well as retrofitting existing shotguns, to enable either optics enhanced, or non-optics enhanced aiming capabilities for shotguns.

BACKGROUND

Current shotgun sight options typically use a fixed bead sighting system, see FIG. 1, bead 100, that may or may not be accompanied by rear sight solutions such as "iron," "ghost," or similar sights 201, see FIG. 2. These sighting mechanisms can be permanently affixed to a shotgun at the fore and rear. While this is a "tried and true" aiming system for shotguns, these systems allow for very little flexibility with respect to users being able to incorporate optics onto shotguns and shotgun platforms.

What is needed is an improved sighting system for shotguns and shotgun platform firearms. Accordingly, it is an object of the present disclosure to provide a shotgun optic plate cover with an integrated rear sight to allow shotgun users to select between traditional rear sights, affixing optics to their shotgun, or quickly removing the optics to revert to traditional sights, all without permanently marring or damaging the shotgun.

Citation or identification of any document in this application is not an admission that such a document is available as prior art to the present disclosure.

SUMMARY

The above objectives are accomplished according to the present disclosure by providing in one aspect an optic-ready shotgun optic plate cover. The plate cover may include at least one optic plate cover configured to affix to a shotgun receiver; at least one rear site integrated into the at least one optic plate cover and extending upward from at least one upper surface of the at least one optic plate cover; at least one optic fastener opening defined in the at least one upper surface of the at least one optic plate cover; and at least one front face, at least one back face, at least one first side wall, and at least one second side wall extending downward from the at least one upper surface of the at least one optic plate cover. Further, the at least one optic plate cover bed may be formed into a shotgun receiver to accommodate the at least one optic shotgun optic plate. Still yet, at least two optic fastener openings may be defined on an upper surface of the at least one optic plate cover. Again, the at least one first side wall and the at least one second side wall may be angled with respect to the at least one upper surface of the at least one optic plate cover. Moreover, the at least one front face may be angled with respect to the at least one upper surface of the at least one optic plate cover. Still moreover, at least one outswell may be defined into either the at least one first side wall or the at least one second side wall. Further yet, the at least one first side wall, the at least one second side wall, and the at least one front face may be angled with respect to the at least one upper surface of the at least one optic plate cover. Yet still, the at least one first side wall and the at least one second side wall may be angled at a first angle and the at least one front face may be angled at a second angle, all with respect to the at least one upper surface of the at least one optic plate cover, and the first angle and the second angle are not equal. Still yet further, the at least two optic fastener openings may be defined and dimensioned in the at least one upper surface to accommodate optic mounting footprints including RMSc, RMS, SMS, Noblex, Docter, Leupold, Leupold DeltaPoint Pro, Trijicon RMR Mounting Standard, C-More Mounting Standard, Shield RMSc Mounting Standard, Glock Modular Optic System, or Springfield Armory Variable Interface System.

In a further aspect, a method for making an optic-ready shotgun optic plate cover is provided. The method may include forming at least one optic plate cover; defining at least one rear site integrated into the at least one optic plate cover that extends upward from at least one upper surface of the at least one optic plate cover; defining at least one optic fastener opening in the at least one upper surface of the at least one optic plate cover; and defining at least one front face, at least one back face, at least one first side wall, and at least one second side wall extending downward from the at least one upper surface of the at least one optic plate cover. Further still, at least one optic plate cover bed may be formed into a shotgun receiver to accommodate the at least one optic shotgun optic plate. Moreover, at least two optic fastener openings may be defined into an upper surface of the at least one optic plate cover. Still further yet, the at least one first side wall and the at least one second side wall may be angled with respect to the at least one upper surface of the at least one optic plate cover. Further again, the at least one front face may be angled with respect to the at least one upper surface of the at least one optic plate cover. Further still, at least one outswell may be defined into either the at least one first side wall or the at least one second side wall. Again, the at least one first side wall, the at least one second side wall, and the at least one front face may all be angled with respect to the at least one upper surface of the at least one optic plate cover. Still again, the at least one first side wall and the at least one second side wall may be angled at a first angle and the at least one front face may be angled at a second angle, all angled with respect to the at least one upper surface of the at least one optic plate cover, and the first angle and the second angle are not equal. Again further, the at least two optic fastener openings may be dimensioned in the at least one upper surface to accommodate optic mounting footprints including RMSc, RMS, SMS, Noblex, Docter, Leupold, Leupold DeltaPoint Pro, Trijicon RMR Mounting Standard, C-More Mounting Standard, Shield RMSc Mounting Standard, Glock Modular Optic System, or Springfield Armory Variable Interface System.

In a further aspect, the current disclosure may provide a method for retrofitting an existing shotgun to incorporate an optic-ready shotgun optic plate cover. The retrofitting method may include forming at least optic plate cover bed into a shotgun receiver; configuring at least one optic plate cover to affix to the at least optic plate cover bed formed into the shotgun receiver; the at least one optic plate cover may be configured to include: at least one rear site integrated into the at least one optic plate cover and extending upward from at least one upper surface of the at least one optic plate cover; at least two optic fastener openings defined into the at least one upper surface of the at least one optic plate cover; and at least one front face, at least one back face, at least one first side wall, and at least one second side wall extending downward from the at least one upper surface of the at least one optic plate cover. Further yet again, the retrofitting method may include forming the at least two optic fastener openings to accommodate optic mounting footprints including RMSc, RMS, SMS, Noblex, Docter, Leupold, Leupold DeltaPoint Pro, Trijicon RMR Mounting Standard, C-More Mounting Standard, Shield RMSc Mounting Standard, Glock Modular Optic System, or Springfield Armory Variable Interface System.

These and other aspects, objects, features, and advantages of the example embodiments will become apparent to those having ordinary skill in the art upon consideration of the following detailed description of example embodiments.

BRIEF DESCRIPTION OF THE DRAWINGS

An understanding of the features and advantages of the present disclosure will be obtained by reference to the following detailed description that sets forth illustrative embodiments, in which the principles of the disclosure may be utilized, and the accompanying drawings of which.

Figure 1:
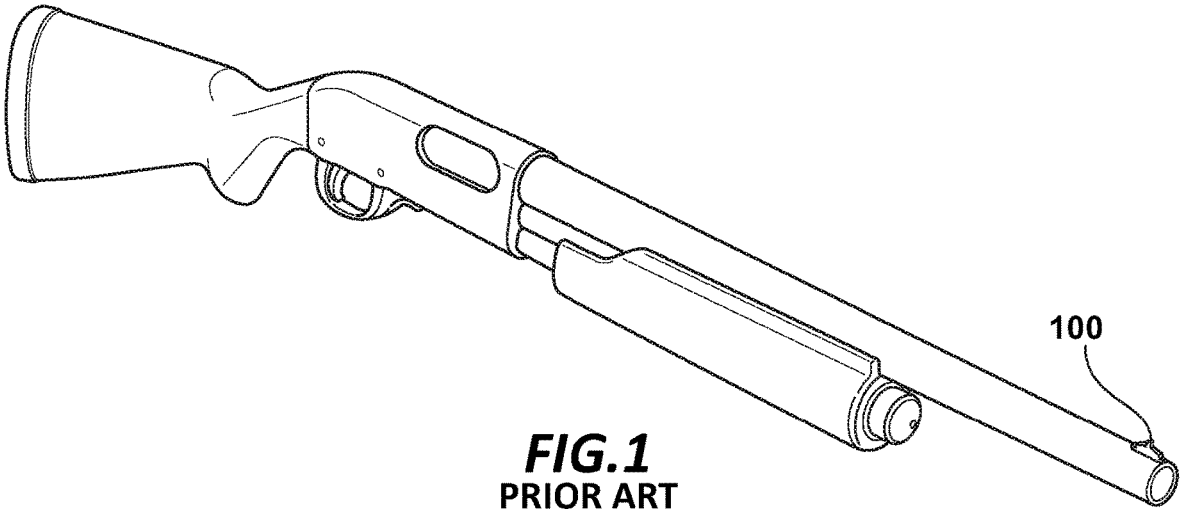
FIG.1 PRIOR ART
FIG. 1 shows a prior art bead sight for a shotgun.
Figure 2:
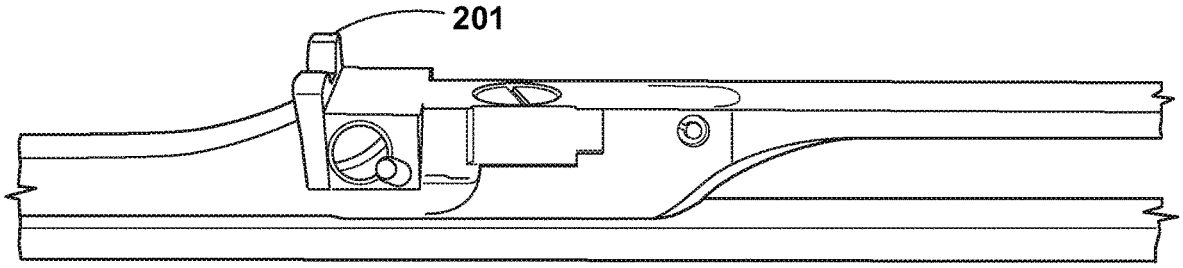
FIG.2 PRIOR ART
FIG. 2 shows a prior art iron sight for a shotgun.

The figures herein are for illustrative purposes only and are not necessarily drawn to scale.

DETAILED DESCRIPTION OF THE EXAMPLE EMBODIMENTS

Before the present disclosure is described in greater detail, it is to be understood that this disclosure is not limited to particular embodiments described, and as such may, of course, vary. It is also to be understood that the terminology used herein is for the purpose of describing particular embodiments only and is not intended to be limiting.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are cited to disclose and describe the methods and/or materials in connection with which the publications are cited. All such publications and patents are herein incorporated by references as if each individual publication or patent were specifically and individually indicated to be incorporated by reference. Such incorporation by reference is expressly limited to the methods and/or materials described in the cited publications and patents and does not extend to any lexicographical definitions from the cited publications and patents. Any lexicographical definition in the publications and patents cited that is not also expressly repeated in the instant application should not be treated as such and should not be read as defining any terms appearing in the accompanying claims. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Where a range is expressed, a further embodiment includes from the one particular value and/or to the other particular value. The recitation of numerical ranges by endpoints includes all numbers and fractions subsumed within the respective ranges, as well as the recited endpoints. Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure. For example, where the stated range includes one or both of the limits, ranges excluding either or both of those included limits are also included in the disclosure, e.g., the phrase "x to y" includes the range from 'x' to 'y' as well as the range greater than 'x' and less than 'y'. The range can also be expressed as an upper limit, e.g., 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', 'greater than y', and 'greater than z'. In addition, the phrase "about 'x' to 'y'", where 'x' and 'y' are numerical values, includes "about 'x' to about 'y'".

It should be noted that ratios, concentrations, amounts, and other numerical data can be expressed herein in a range format. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. Ranges can be expressed herein as from "about" one particular value, and/or to "about" another particular value. Similarly, when values are expressed as approximations, by use of the antecedent "about," it will be understood that the particular value forms a further aspect. For example, if the value "about 10" is disclosed, then "10" is also disclosed.

It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., about 1%, about 2%, about 3%, and about 4%) and the sub-ranges (e.g., about 0.5% to about 1.1%; about 5% to about 2.4%; about 0.5% to about 3.2%, and about 0.5% to about 4.4%, and other possible sub-ranges) within the indicated range.

As used herein, the singular forms "a" "an", and "the" include both singular and plural referents unless the context clearly dictates otherwise.

As used herein, "about," "approximately," "substantially," and the like, when used in connection with a measurable variable such as a parameter, an amount, a temporal duration, and the like, are meant to encompass variations of and from the specified value including those within experimental error (which can be determined by e.g., given data set, art accepted standard, and/or with e.g., a given confidence interval (e.g., 90%, 95%, or more confidence interval from the mean), such as variations of +/−10% or less, +1-5% or less, +/−1% or less, and +/−0.1% or less of and from the specified value, insofar such variations are appropriate to perform in the disclosure. As used herein, the terms "about," "approximate," "at or about," and "substantially" can mean that the amount or value in question can be the exact value or a value that provides equivalent results or effects as recited in the claims or taught herein. That is, it is understood that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art such that equivalent results or effects are obtained. In some circumstances, the value that provides equivalent results or effects cannot be reasonably determined. In general, an amount, size, formulation, parameter or other quantity or characteristic is "about," "approximate," or "at or about" whether or not expressly stated to be such. It is understood that where "about," "approximate," or "at or about" is used before a quantitative value, the parameter also includes the specific quantitative value itself, unless specifically stated otherwise.

The term "optional" or "optionally" means that the subsequent described event, circumstance or substituent may or may not occur, and that the description includes instances where the event or circumstance occurs and instances where it does not.

As used interchangeably herein, the terms "sufficient" and "effective," can refer to an amount (e.g., mass, volume, dosage, concentration, and/or time period) needed to achieve one or more desired and/or stated result(s). For example, a therapeutically effective amount refers to an amount needed to achieve one or more therapeutic effects.

As used herein, "tangible medium of expression" refers to a medium that is physically tangible or accessible and is not a mere abstract thought or an unrecorded spoken word. "Tangible medium of expression" includes, but is not limited to, words on a cellulosic or plastic material, or data stored in a suitable computer readable memory form. The data can be stored on a unit device, such as a flash memory or CD-ROM or on a server that can be accessed by a user via, e.g., a web interface.

Various embodiments are described hereinafter. It should be noted that the specific embodiments are not intended as an exhaustive description or as a limitation to the broader aspects discussed herein. One aspect described in conjunction with a particular embodiment is not necessarily limited to that embodiment and can be practiced with any other embodiment(s). Reference throughout this specification to "one embodiment", "an embodiment," "an example embodiment," means that a particular feature, structure or characteristic described in connection with the embodiment is included in at least one embodiment of the present disclosure. Thus, appearances of the phrases "in one embodiment," "in an embodiment," or "an example embodiment" in various places throughout this specification are not necessarily all referring to the same embodiment but may. Furthermore, the particular features, structures or characteristics may be combined in any suitable manner, as would be apparent to a person skilled in the art from this disclosure, in one or more embodiments. Furthermore, while some embodiments described herein include some, but not other features included in other embodiments, combinations of features of different embodiments are meant to be within the scope of the disclosure. For example, in the appended claims, any of the claimed embodiments can be used in any combination.

All patents, patent applications, published applications, and publications, databases, websites and other published materials cited herein are hereby incorporated by reference to the same extent as though each individual publication, published patent document, or patent application was specifically and individually indicated as being incorporated by reference.

Kits

Any of the shotgun optics plates, methods for making or methods for retrofitting an existing shotgun described herein may be presented as a combination kit. As used herein, the terms "combination kit" or "kit of parts" refers to the parts, tools, accessories and any additional components that are used to package, sell, market, deliver, and/or provide the combination of elements or a single element, such as the optic plate cover with an integrated rear sight. Such additional components include, but are not limited to packaging, blister packages, tools, and the like. When one or more of the parts, tools, accessories and any additional components described herein or a combination thereof (e.g., parts in the kit are provided simultaneously), the combination kit can contain the improved optic plate cover with integrated rear sight singularly or in separate embodiments. When the parts, tools, accessories and any additional components described herein or a combination thereof and/or kit components are not provided simultaneously, the combination kit can contain the parts, tools, accessories and any additional components in separate embodiments. The separate kit components can be contained in a single package or in separate packages within the kit.

In some embodiments, the combination kit also includes instructions printed on or otherwise contained in a tangible medium of expression. The instructions can provide information regarding the parts, tools, accessories and any additional components, safety information regarding the contents, information regarding use, and/or recommended maintenance regimen(s) for the parts, tools, accessories and any additional components contained therein. In some embodiments, the instructions can provide directions and protocols for assembling or installing the parts, tools, accessories and any additional components described herein. In some embodiments, the instructions can provide one or more embodiments of the optic plate cover with integrated rear sight or methods for making or retrofitting an existing shotgun to include the optic plate cover with integrated rear sight such as any of the methods described in greater detail elsewhere herein.

Red dot optics are common on handguns and rifles but not on shotguns. While some attempts have been made to provide improved optics for shotguns, none have attempted to provide an optic-ready plate cover with an integrated rear sight for use with shotguns and shotgun platforms. Herein, "optic ready" means an optic plate cover manufactured with pre-cut features on the optic plate cover that allow for the direct mounting of an optic, like a red dot sight, without requiring additional custom gunsmithing to add the capability; essentially, it comes ready to accept an optic "right out of the box."

Figure 3:
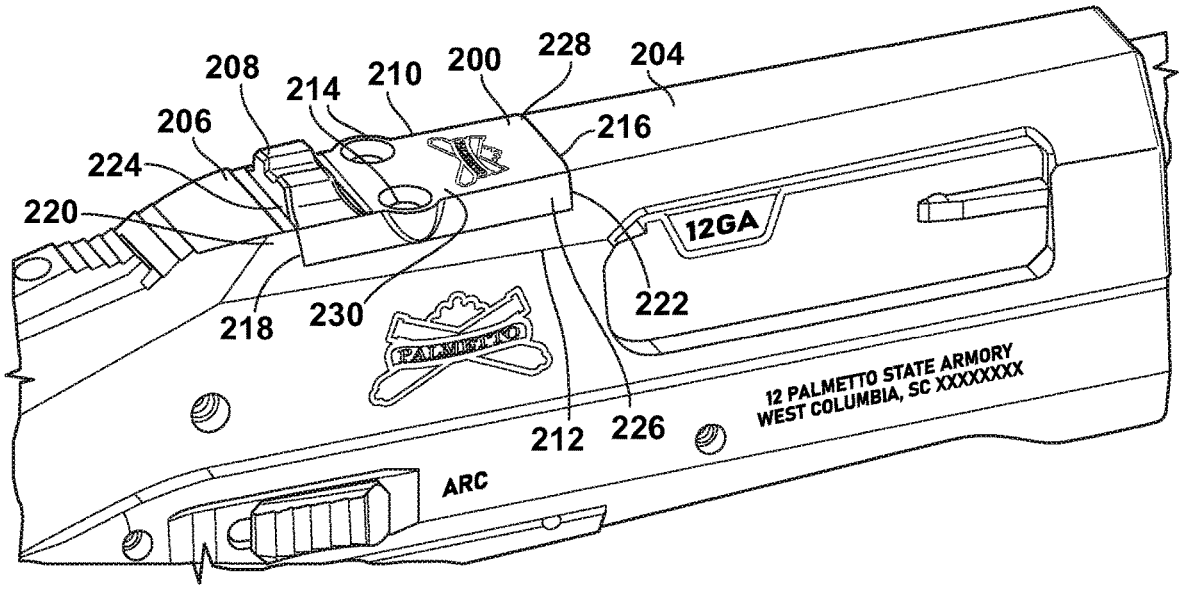
FIG. 3 shows one embodiment of a shotgun optic plate with integrated rear sight of the current disclosure.
Figure 4:
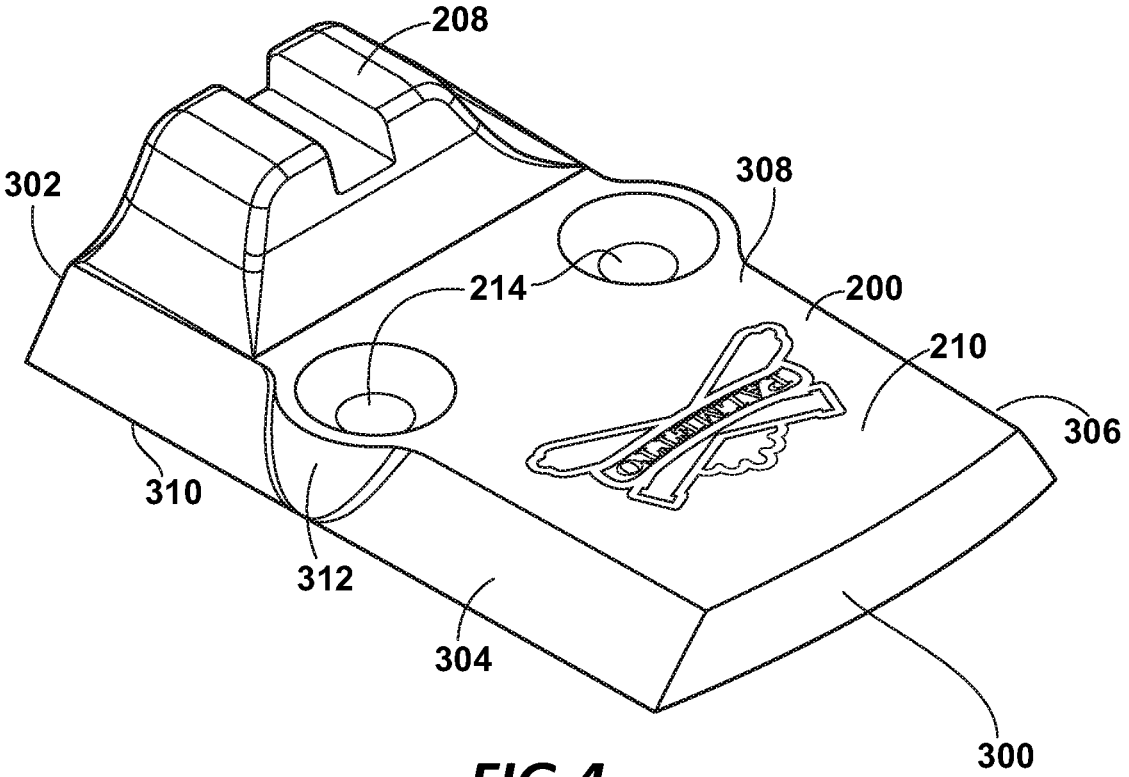
FIG. 4 shows a standalone view of shotgun optic plate with integrated rear sight.

Referring to FIGS. 3 and 4, the current disclosure uses the optic plate cover 200 to integrate a back-up sighting system onto a shotgun receiver 204. As FIG. 3 shows, optic plate cover 200 may be affixed to an upper portion of a shotgun receiver 204 barrel proximal end 206 with optic plate cover body being "flush" or recessed into shotgun receiver 204 to provide a streamlined appearance as well as prevent optic plate cover 200 from snagging on obstacles when used in the field. Optic plate cover 200 may include integrated rear site 208 formed into optic plate cover body 210 and extending upward from optic plate cover upper surface 220. Optic plate cover 200 may be affixed to optic plate cover bed 212 via fasteners, not shown, such as threaded bolts, screws, or other fasteners as known to those of skill in the art, frictional engagement, adhesives, etc. In one embodiment, optic plate cover 200 may be affixed via screws. Optic plate cover 200 may configured as removable with respect to the shotgun receiver by undoing screws, fasteners, etc. Further, optic plate cover 200 may be configured in different styles to accommodate different users, such as variants to rear site 208 to allow users to place in a preferred type of site or to replace optic plate cover 200 in the field. Indeed, rear site 208 may be permanently affixed and defined as a part of optic plate cover 200 or may be defined as removable with respect to optic plate cover to allow a user to replace only rear site 208 with another site style, or replace a damages rear site 208, without having to completely remove optic plate cover 200.

Optics, not shown, may engage with optic plate cover 200 via optics fastener openings 214 defined on upper surface 220 of optic plate cover 200. Whiles two optics fasteners openings 214 are shown, the current disclosure is not so limited and one, three, four, five, six, etc., optics fastener openings 214 may be employed to affix optics to optic plate cover 200. These optics may be releasably fastened via optics fastener openings 214 and the associated fasteners used with the optics such that optics may be added to or removed from the shotgun quickly and efficiently without marring, damaging, or further altering the shotgun itself. Further, while optics fastener openings 214 are shown as round, they may be any shape including polygonal, oval, circular, irregular shaped, etc., and are not limited to the shapes shown. Optic plate cover 200 may fit between optic plate cover bed front 216 and optic plate cover bed rear 218 to be held firmly into shotgun body 220.

Further, optics fastener openings 214 may be the same or different sizes with respect to one another. This allows a user to have the option of employing only a single screw, bolt, or other affixing means to secure a first type of optic with a particularly sized screw, bolt, or other affixing means, while providing a second, differently sized hole, to accommodate another optic having a differently sized screw, bolt, or other affixing means to secure a first type of optic. Further, differently sized "pairs" of optics fastener openings may be provided in the optic plate cover body to accommodate optics with different frames or distances between their respective affixing members and to allow a user to affix an optic using two or more of the optics fastener openings rather than using a single opening. For purposes of example only and not intended to be limiting, two pairs of optic fastener openings 214 with the first pair of optic fastener openings being sized differently with respect to width, depth, screw/bolt thread taper, etc., from the second pair to accommodate optics with different frames, affixing means, etc. Further, the differently sized "pairs" of optics fastener openings may also vary in spacing from another to accommodate optics having screws, bolts, or other affixing means, such as a first pair of optics fastener openings being spaced from 10 to 70 mm apart and the second pair of optics fastener openings being spaced from 10 to 60 mm apart. This example should not be considered limiting at the distance between a single pair, or multiple pairs, of optics fastener openings 214 may range from 10 to 70 mm, including measurements within this range such as 5, 10, 15, 20, 25, 30, 35, 40, 45, 50, 55, 60, 65 and ranges of these values such as 15 to 70, 20 to 60, 25 to 45, 40 to 60, etc. This also includes values not specifically stated as one of the above measurements or ranges that fall between the above values/range and are hereby considered disclosed by the current disclosure, such as, and not intended to be limiting, 14 mm, 22 mm, from 10 mm to 20 mm, from 11 to 15 mm, etc.

The dimensions of a firearm optics frame, specifically for a red dot sight, typically include a lens width ranging from 40 mm to 60 mm, with the key measurement being the "footprint" which determines compatibility with the slide or receiver of the firearm and varies depending on the specific optic and gun model. Various optic footprints exist in the firearms industry with popular footprints commonly used on compact handguns, and larger footprints for full-size handguns and rifles (and now shotguns as disclosed herein). The optic plate cover body 210 may be dimensioned and designed to cooperate with these various optic footprints via placement of the optic fastener openings 214 on optic plate cover body 210. For example, the optic plate cover body 210 and optic fastener openings 214 may be placed, defined, and/or dimensioned to accommodate RMSc, RMS, SMS, Noblex, Docter, Leupold, Leupold DeltaPoint Pro, Trijicon RMR Mounting Standard, C-More Mounting Standard, Shield RMSc Mounting Standard, Glock Modular Optic System, Springfield Armory Variable Interface System, etc. optics footprints. This versatility allows the current disclosure to accommodate not only the footprint of the optic to be employed, but the optics mounting height and length as well as accommodate the style of shooting the optic will be employed to achieve such as close range or long-range shooting. Indeed, the current disclosure allows users to have many options with respect to personal preference when "dressing out" a shotgun firearm with optics.

By "dimensioned," with respect to forming and placing the optic fastener openings into optic plate cover body 210, this means forming the optics fastener openings 214 in depth, width, threading measurements, threading style, etc., to accommodate the means for affixing the optics provided by the original equipment manufacturer, with the depth, width, threading measurements, threading style, etc., required to accommodate the means for affixing the optics known to those of skill in the art and will not require undo experimentation to practice the disclosure herein. Additionally, physical placement and spacing of the optics fastener openings 214 atop the optic plate cover 200 is included within the definition of "dimensioned." Those of skill in the art will know and understand, or be able to easily discover with minimal effort, the physical placing/spacing of the optics fastener openings 214 required in order to form same into the optic plate cover 200 to accommodate the OEM affixing means provided with the optics to be affixed to a shotgun by the manufacturer of the optics. Thus, dimensioning the optics fastener openings 214 to accommodate various optic manufacturer footprints is clearly enabled and easily understood by those of skill in the art with respect to the present disclosure.

Further, optic cover plate body 210 may be formed to be substantially trapezoidal in shape with respect to its front face 222, rear face 224, first side 226 and second side 228 having a tilt or angle with respect to top plane 230 of optic cover plate body 210, which will be considered to be horizontal for purposes of measuring the tile or angle of the faces and sides. The tilt or angle with respect to front face 222, rear face 224, first side 226 and second side 228 may range over a series of degrees from 5, 10, 15, 20, 25, 30, 35, 40, 45, 50, 55, 60, 65, 70, 75, 80, 85, and up to 90 degrees, as well as variations within the stated degrees, such as 43, 61, 88 degrees, etc., as well as ranges covering the stated degrees such as from 10 to 90 degrees, 20 to 90 degrees, 30 to 90 degrees, 40 to 90 degrees, 45 to 90 degrees, 50 to 90 degrees, 55 to 90 degrees, 60 to 90 degrees, 65 to 90 degrees, 70 to 90 degrees, 75 to 90 degrees, 80 to 90 degrees, and/or 85 to 90 degrees, etc., with respect to top plane 230 of optic cover plate body 210. Further, each wall may have the same tilt, some walls may have the same tilt, opposing faces or sides, such as front face 222 and rear face 224 may have the same tilt while first side 224 and second side 226 have the same tilt angle with respect to one another while having a different tilt angle with respect to front face 222 and rear face 224. Indeed, both faces and sides may be positioned at 90 degrees with respect to top plane 230. In other embodiments, front face 222 and rear face 224 may be positioned at 90 degrees, or substantially or approximately 90 degrees, with respect to top plane 230 while first side 226 and second side 228 may be angled such as from 30 to 90 degrees. This allows for a vast improvement over prior art devices as well as allows for customizing optic cover plate 200 for retrofitting into existing shotgun platforms without marring or otherwise changing the slopes or planes associated with the existing shotgun. Further, angling either the front or back face may allow for "dove tailing" or affixing optic cover plate 200 more firmly into a shogun upper receiver by having a cut out in the shotgun receiver engage, partially or completely overlap, and/or hold optic cover plate body 210 into place by firm engagement with front face 222 and/or rear face 224. Indeed, this may be accomplished without the need for adhesives or other similar measures.

With respect to FIG. 4, optic cover plate 200 may include optic cover plate front face 300, optic cover plate rear face 302, optic cover plate first side 304, optic cover plate second side 306, optic cover plate top surface 308, and optic cover plate bottom surface 310. As FIG. 4 shows, optic cover plate first side 304 and optic cover plate second side 306 may define optic cover plate outswells 312 as part of optics fastener openings 214 to accommodate inserting screws, bolts, or other affixing means that come standard with optics to affix the optic into optics fastener openings 214. Thus, one using optic cover plate 200 can accommodate "full size" or traditionally sized screws, bolts, or other such affixing devices that come from the original equipment manufacturer for an optic, without requiring machining of specifically sized/dimensioned fixtures to affix an optic, not shown, to optic cover plate 200. This allows for an optic used on optic cover plate 200 to be easily swapped our or changed without fear of losing a specifically designed and sized screw or bolt in the field needed to affix the optic to optic cover plate 200, whereas loss of a specifically design affixing implement would render the firearm useless until a replacement is found. Further, while optics fastener openings 214 are shown as located in front of rear site 208 with respect to optic cover plate rear face 302, the current disclosure is not so limited and optics fastener openings 214 may be located behind rear site 208 with respect to optic cover plate rear face 302.

The current disclosure also provides methods for installing and retrofitting an existing shotgun to accommodate optic plate 200. For instance, one may take an existing shotgun and form optic cover plate bed 212, cover plate bed front 216, and optic cover plate bed rear 218 into the body of a pre-existing shotgun, which may or may not have rear sights, via milling, drilling, woodworking, etc., in order to define a space sized to hold optic cover plate 200 in the pre-existing shotgun body. Further, the space may be dimensioned so that optic cover plate top surface 308 is substantially equal in height or substantially in line with the level of the upper surface of the pre-existing shotgun body extending distally from optic cover plate 200.

Various modifications and variations of the described methods, devices, and kits of the disclosure will be apparent to those skilled in the art without departing from the scope and spirit of the disclosure. Although the disclosure has been described in connection with specific embodiments, it will be understood that it is capable of further modifications and that the disclosure as claimed should not be unduly limited to such specific embodiments. Indeed, various modifications of the described modes for carrying out the disclosure that are obvious to those skilled in the art are intended to be within the scope of the disclosure. This application is intended to cover any variations, uses, or adaptations of the disclosure following, in general, the principles of the disclosure and including such departures from the present disclosure come within known customary practice within the art to which the disclosure pertains and may be applied to the essential features herein before set forth.

What is claimed is:

1. An optic-ready shotgun optic plate cover comprising: at least one optic plate cover configured to affix to a shotgun receiver; at least one rear site integrated into the at least one optic plate cover and extending upward from at least one upper surface of the at least one optic plate cover;

at least two optic fastener openings, the at least two optic fastener openings being different sizes and spaced to accommodate different optic mounting footprints, defined in the at least one upper surface of the at least one optic plate cover; and at least one front face, at least one back face, at least one first side wall, and at least one second side wall extending downward from the at least one upper surface of the at least one optic plate cover, wherein at least one outswell is defined into either the at least one first side wall or the at least one second side wall as part of an optic fastener opening to accommodate an OEM optic fastener.

2. The optic-ready shotgun optic plate cover of claim 1, wherein the at least one optic plate cover is configured to affix within an optic plate cover bed formed into the shotgun receiver to accommodate the at least one optic plate cover.

3. The optic-ready shotgun optic plate cover of claim 1, further comprising at least two optic fastener openings defined on an upper surface of the at least one optic plate cover, wherein a first pair of the optic fastener openings differs in size or spacing from a second pair of the optic fastener openings to accommodate different optics.

4. The optic-ready shotgun optic plate cover of claim 3, further comprising wherein the at least two optic fastener openings defined in at least one upper surface are dimensioned to accommodate optic mounting footprints including RMSc, RMS, Noblex, Docter, Leupold, Leupold DeltaPoint Pro, Trijicon RMR Mounting Standard, C-More Mounting Standard, Shield RMSc Mounting Standard, Glock Modular Optic System, or Springfield Armory Variable Interface System by providing differently sized pairs of openings having different spacings for at least two different listed footprints.

5. The optic-ready shotgun optic plate cover of claim 1, further comprising wherein the at least one first side wall and the at least one second side wall are angled with respect to the at least one upper surface of the at least one optic plate cover at a first angle, and a front face of the optic plate cover is angled at a second angle different from the first angle.

6. The optic-ready shotgun optic plate cover of claim 1, further comprising wherein the at least one front face is angled with respect to the at least one upper surface of the at least one optic plate cover to engage a receiver cutout and hold the optic plate cover in place by firm engagement with the front face.

7. The optic-ready shotgun optic plate cover of claim 1, further comprising wherein at least one outswell is defined into either the at least one first side wall or the at least one second side wall as part of an optic fastener opening to accommodate inserting a standard OEM screw or bolt for an optic.

8. The optic-ready shotgun optic plate cover of claim 1, further comprising wherein the at least one first side wall, the at least one second side wall, and the at least one front face are angled with respect to the at least one upper surface of the at least one optic plate cover such that the angled front face and angled side walls match corresponding slopes of a receiver bed formed into the shotgun receiver.

9. The optic-ready shotgun optic plate cover of claim 8, further comprising wherein the at least one first side wall and the at least one second side wall are angled at a first angle and the at least one front face is angled at a second angle, all with respect to the at least one upper surface of the at least one optic plate cover, and the first angle and the second angle are not equal, whereby the front face is configured for dovetail-like engagement with a receiver cutout while the side walls are configured to match side slopes of the receiver bed.

10. A method for making an optic-ready shotgun optic plate cover comprising: forming at least one optic plate cover; defining at least one rear site integrated into the at least one optic plate cover that extends upward from at least one upper surface of the at least one optic plate cover;

defining at least two optic fastener openings having different sizes or pair spacings to accommodate different optic mounting footprints in the at least one upper surface of the at least one optic plate cover; and defining at least one front face, at least one back face, at least one first side wall, and at least one second side wall extending downward from the at least one upper surface of the at least one optic plate cover, including defining at least one outswell into either the first side wall or the second side wall as part of an optic fastener opening.

11. The method for making an optic-ready shotgun optic plate cover of claim 10, further comprising forming at least one optic plate cover bed into a shotgun receiver to accommodate the at least one optic plate cover so that a top surface of the optic plate cover is substantially equal in height to an upper surface of the shotgun receiver.

12. The method for making an optic-ready shotgun optic plate cover of claim 10, further comprising defining at least two optic fastener openings into an upper surface of the at least one optic plate cover, including defining a first pair with a first spacing and a second pair with a different spacing.

13. The method for making an optic-ready shotgun optic plate cover of claim 12, further comprising dimensioning the at least two optic fastener openings in the at least one upper surface to accommodate optic mounting footprints including RMSc, RMS, Noblex, Docter, Leupold, Leupold DeltaPoint Pro, Trijicon RMR Mounting Standard, C-More Mounting Standard, Shield RMSc Mounting Standard, Glock Modular Optic System, or Springfield Armory Variable Interface System by providing differently sized pairs of openings with different spacings for at least two different footprint families.

14. The method for making an optic-ready shotgun optic plate cover of claim 10, further comprising angling the at least one first side wall and the at least one second side wall with respect to the at least one upper surface of the at least one optic plate cover at a first angle different from an angle of a front face of the optic plate cover.

15. The method for making an optic-ready shotgun optic plate cover of claim 10, further comprising angling the at least one front face with respect to the at least one upper surface of the at least one optic plate cover to provide dovetail-like engagement with a receiver cutout.

16. The method for making an optic-ready shotgun optic plate cover of claim 10, further comprising defining at least one outswell into either the at least one first side wall or the at least one second side wall as part of an optic fastener opening to accommodate a standard OEM optic mounting screw or bolt.

17. The method for making an optic-ready shotgun optic plate cover of claim 10, further comprising angling the at least one first side wall, the at least one second side wall, and the at least one front face with respect to the at least one upper surface of the at least one optic plate cover to match corresponding slopes and faces of a receiver bed formed into the shotgun receiver.

18. The method for making an optic-ready shotgun optic plate cover of claim 10, further comprising angling the at least one first side wall and the at least one second side wall at a first angle and angling the at least one front face at a second angle, all angled with respect to the at least one upper surface of the at least one optic plate cover, and the first angle and the second angle are not equal, wherein the second angle is selected to provide dovetail-like engagement with a receiver cutout.

19. A method for retrofitting an existing shotgun to incorporate an optic-ready shotgun optic plate cover comprising:

forming at least optic plate cover bed into a shotgun receiver so that an upper surface of the optic plate cover is flush with or recessed into the shotgun receiver when installed;

configuring at least one optic plate cover to affix to the at least optic plate cover bed formed into the shotgun receiver via screws so that the optic plate cover is removable from the shotgun receiver;

configuring the at least one optic plate cover to include:

at least one rear site integrated into the at least one optic plate cover and extending upward from at least one upper surface of the at least one optic plate cover;

at least two optic fastener openings defined into the at least one upper surface of the at least one optic plate cover, the at least two optic fastener openings including differently sized pairs or different spacings for accommodating different optic mounting footprints; and at least one front face, at least one back face, at least one first side wall, and at least one second side wall extending downward from the at least one upper surface of the at least one optic plate cover, wherein at least one outswell is defined into either the first side wall or the second side wall as part of an optic fastener opening.

20. The method for retrofitting an existing shotgun to incorporate an optic-ready shotgun optic plate cover of claim 19, further comprising defining the at least two optic fastener openings to accommodate optic mounting footprints including RMSc, RMS, Noblex, Docter, Leupold, Leupold DeltaPoint Pro, Trijicon RMR Mounting Standard, C-More Mounting Standard, Shield RMSc Mounting Standard, Glock Modular Optic System, or Springfield Armory Variable Interface System by providing differently sized pairs of openings having different spacings for at least two different listed footprints.

* * * * *